US007722381B2

(12) United States Patent
Hiramatsu

(10) Patent No.: US 7,722,381 B2
(45) Date of Patent: May 25, 2010

(54) CONNECTOR

(75) Inventor: Hiroyuki Hiramatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 264 days.

(21) Appl. No.: 11/823,903

(22) Filed: Jun. 29, 2007

(65) Prior Publication Data

US 2008/0009186 A1 Jan. 10, 2008

(30) Foreign Application Priority Data

Jul. 4, 2006 (JP) ..... 2006-184706

(51) Int. Cl.
*H01R 13/648* (2006.01)

(52) U.S. Cl. ..... 439/385; 439/596

(58) Field of Classification Search ..... 439/271, 439/382–385, 592, 595, 586–587, 732
See application file for complete search history.

(56) References Cited

U.S. PATENT DOCUMENTS 4,333,699 A * 6/1982 Brorein ..... 439/592
6,793,513 B2 * 9/2004 Shibata ..... 439/271
7,104,831 B2 * 9/2006 Fukatsu et al. ..... 439/385
7,311,546 B2 * 12/2007 Itou ..... 439/385

FOREIGN PATENT DOCUMENTS

JP 2001-307819 11/2001
JP 2003-229195 12/2003

* cited by examiner

*Primary Examiner*—Xuong M Chung-Trans
(74) *Attorney, Agent, or Firm*—Gerald E. Hespos; Anthony J. Casella

(57) ABSTRACT

A male housing (60) includes a receptacle (61) in which male tabs project. A female housing (10) includes a tower (11) with cavities (14) for accommodating terminal fittings. A front holder (13) is mountable on the tower (11) and has a front wall (31). A surrounding wall (32) projects from a peripheral edge of the front wall (31) for covering the outer peripheral surface of the tower (11). A receptacle (61) is fit on the tower (11) with the front holder (13) thereon. Inner projections (43) are provided on the inner peripheral surface of the surrounding wall (32) and project towards the outer peripheral surface of the tower (11) and outer projections (45) are provided on the outer peripheral surface of the surrounding wall (32) and project towards the inner peripheral surface of the receptacle (61).

12 Claims, 7 Drawing Sheets

CONNECTOR

BACKGROUND OF THE INVENTION

1. Field of the Invention

The invention relates to a connector.

2. Description of the Related Art

Japanese Unexamined Patent Publication No. 2001-307819 discloses a connector with two housings that are connectable with each other. One housing has a tubular receptacle and the other has a tower with cavities for accommodating terminal fittings. Ribs are provided on the inner peripheral surface of the receptacle and project towards the outer surface of the tower to prevent the tower from shaking in the receptacle. Japanese Unexamined Patent Publication No. 2003-229195 discloses another connector with a cap-shaped front holder mounted on the tower. A front wall of the holder forms front walls of the cavities.

FIG. 7 herein shows a connector with a front holder 1 that can be fit on a tower 2, and then fit in a receptacle 3. A clearance is defined between the inner peripheral surface of the receptacle 3 and the outer peripheral surface of the tower 2 at least by the thickness of a surrounding wall of the front holder 1. Ribs 4 project from the inner peripheral surface of the receptacle 3 and have a projecting distance sufficient to fill up the clearance. However, the rib 4 becomes weaker as the projecting distance becomes large.

The invention was developed in view of the above situation, and an object thereof is to prevent a tower and a receptacle from shaking relative to each other without increasing a projecting distance of shake preventing projections in the case where the receptacle is fit on a tower having a front holder mounted thereon.

SUMMARY OF THE INVENTION

The invention relates to a connector with first and second housings that are connectable with each other. The first housing has a tubular receptacle and the second housing has a tower with at least one cavity for accommodating at least one terminal fitting. A front holder is mountable on the tower from the front and has a front wall. A surrounding wall projects from the peripheral edge of the front wall for covering at least part of the outer peripheral surface of the tower. The receptacle is fit from the front onto the tower while the front holder is mounted thereon.

Outer projections are provided on the outer peripheral surface of the surrounding wall and project towards the inner peripheral surface of the receptacle to substantially fill a clearance between the outer peripheral surface of the surrounding wall and the inner peripheral surface of the receptacle. Inner projections are provided on the inner circumferential surface of the surrounding wall and project towards the outer circumferential surface of the tower to substantially fill a clearance between the inner peripheral surface of the surrounding wall and the outer circumferential surface of the tower. The projections prevent the front holder and the tower from shaking in the receptacle. Additionally, the projections project from both the outer and inner peripheral surfaces of the surrounding wall of the front holder. Thus, projecting distances of the outer and inner projections are reduced and the strengths of the outer and inner projections are greater than shake preventing projections that project from only one of the receptacle and the tower.

The outer projections and the inner projections preferably are aligned respectively with one another with the surrounding wall therebetween. Thus, rigidity is improved in parts of the surrounding wall where the outer and inner projections are arranged to prevent deformation of these parts of the surrounding wall when subjected to an external force.

The contact position of mating terminal fittings could displace and impair connection reliability if the tower and the receptacle shake relative to one another. Accordingly, the outer projections or the inner projections preferably are arranged at substantially the same position as the contact position of the terminal fittings with respect to the width direction. Thus, loose movements of the tower in the receptacle are suppressed at a position close to the contact position of the both terminal fittings. Therefore, the connection reliability of the terminal fittings is maintained.

The projecting distance of the outer projections preferably is smaller than that of the inner projections.

At least one front-stop wall for the terminal fitting preferably is formed for the cavity.

An opening edge of a part of a tab insertion opening preferably is formed in the front-stop wall, and a slanted surface for guiding the male tab preferably is formed at the front surface of the opening edge.

These and other features of the invention will become more apparent upon reading the following detailed description of preferred embodiments and accompanying drawings.

DETAILED DESCRIPTION OF THE PREFERRED

A connector in accordance with the invention is described with reference to FIGS. 1 to 6. The connector of this embodiment is a fluid- or watertight connector with female and male housings 10, 60 that are connectable with each other. In the following description, ends of the housings 10, 60 to be connected are referred to as the front ends concerning forward and backward directions FBD, and reference is made to FIG. 1 concerning vertical direction.

Figure 2:
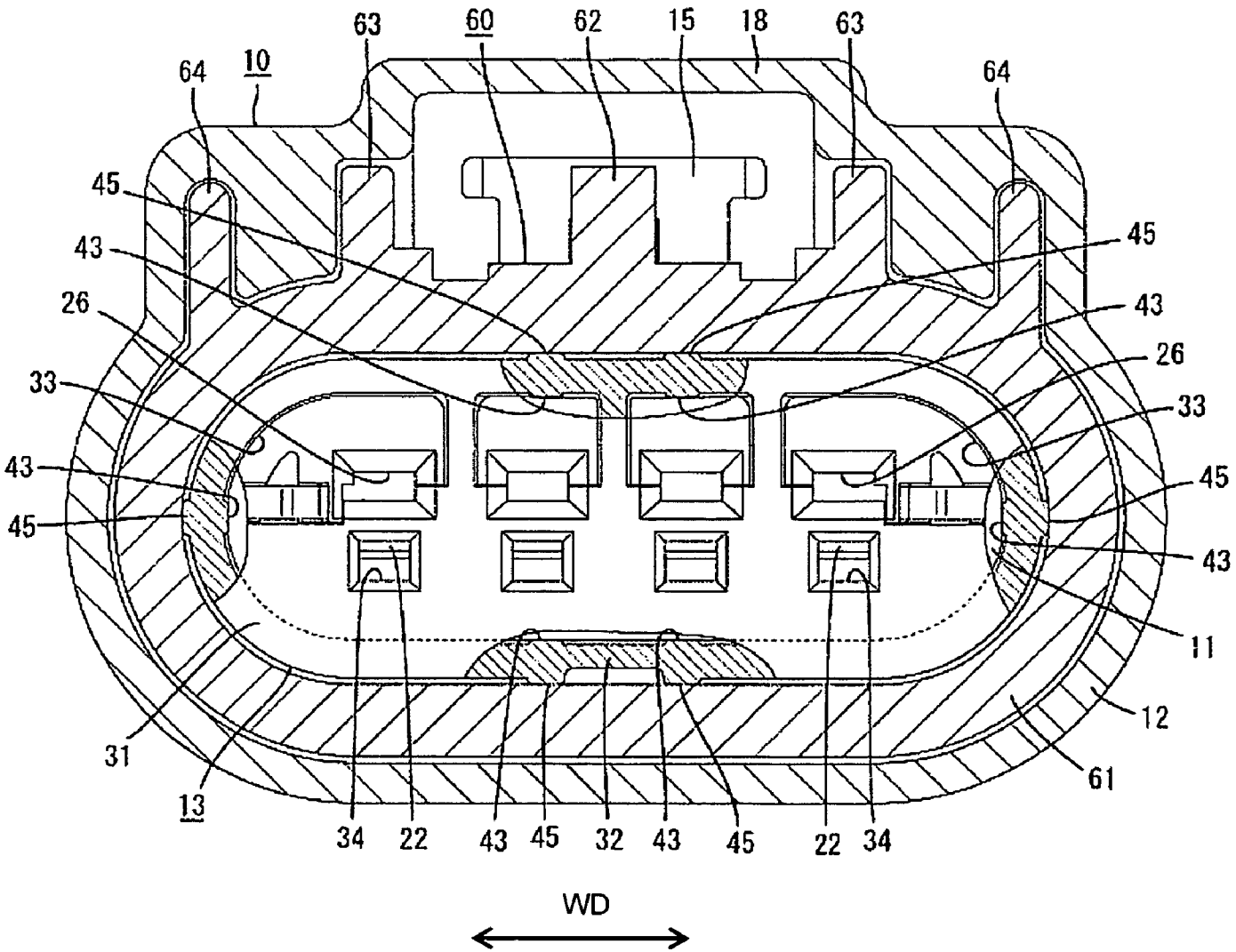
FIG. 2 is a vertical section showing an essential portion of both female and male housings in a connected state.

The male housing 60 is made e.g. of a synthetic resin and, although not shown in detail, includes a substantially tubular receptacle 61, as shown in FIG. 2, in which male tabs (not shown) project. A lock 62 projects in a widthwise intermediate position of the upper wall of the receptacle 61 and protection walls 63 project from the upper wall of the receptacle 61 at the opposite sides of the lock 62. Guide ribs 64 stand near the outer sides of the protection walls 63.

Figure 1:
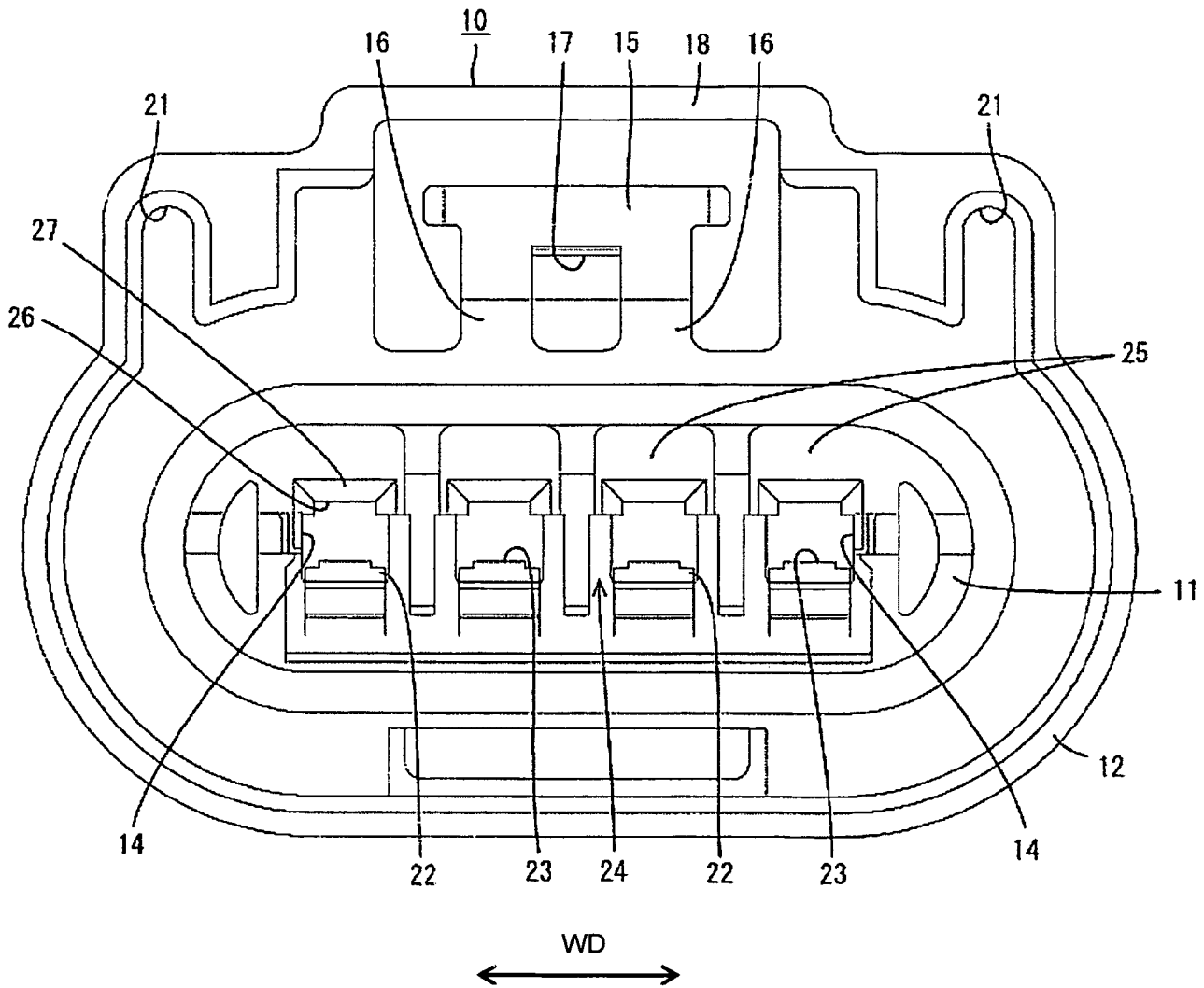
FIG. 1 is a front view of a female housing before a front holder is mounted in one embodiment.

The female housing 10 is made e.g. of a synthetic resin and has a tower 11 capable of accommodating female terminal fittings (not shown). A fitting tube 12 surrounds the tower 11, as shown in FIG. 1. The female housing 10 further includes a front holder 13 to be mounted on the tower 11 from the front. Cavities 14 are arranged substantially in a transverse row and penetrate the tower 11 in forward and backward directions FBD. The terminal fittings are insertable into the cavities 14 from behind. Although not shown, the terminal fittings are crimped, bent or folded into connection with respective ends of wires preferably to which sealing members are mounted.

Figure 3:
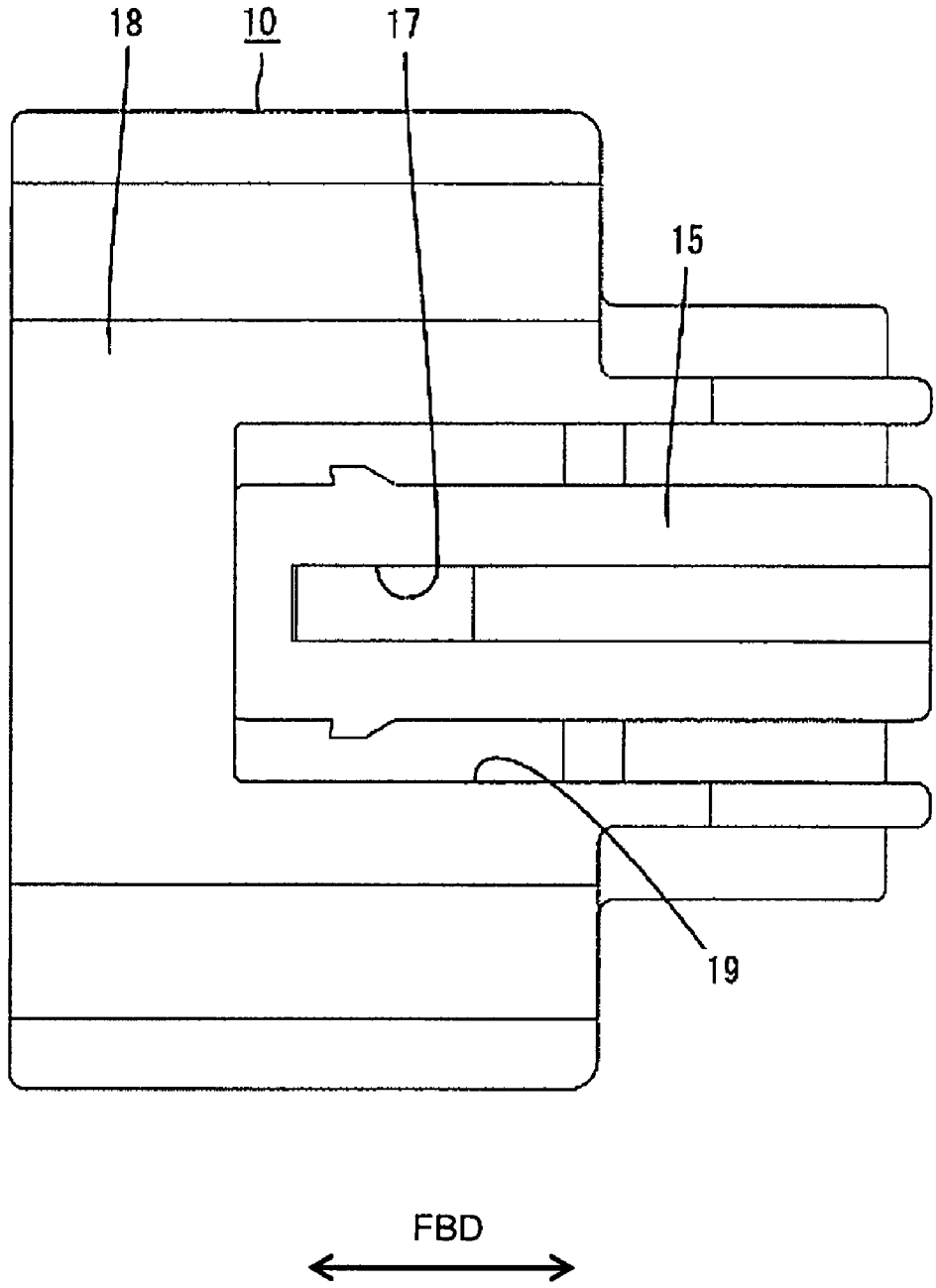
FIG. 3 is a plan view of the female housing.

A pivotally displaceable resilient lock arm 15 is coupled to the upper wall of the tower 11 via a support 16. As shown in FIG. 3, the lock arm 15 extends in forward and backward directions FBD, and a lock groove 17 is formed in a widthwise intermediate position thereof. The lock arm 15 moves onto the lock 62 and is displaced pivotally about a center on the support 16. The lock 62 aligns with the lock groove 17 when the housings 10, 60 are connected properly, and the lock arm 15 resiliently restores so that the lock arm 15 engages the lock 62 to hold the two housings 10, 60 together.

A bulge 18 extends up and out on the upper wall of the fitting tube 2 and an accommodation space for the lock arm 15 is defined inside the bulge 18. A rearwardly open escaping recess 19 is formed in the bulge 18, and the lock arm 15 is exposed through the escaping recess 19. Receiving grooves 21 extend in forward and backward directions FBD in the inner surface of the fitting tube 12 and receive the guide ribs 64 of the receptacle 61.

Locks 22 extend substantially along inner walls of the cavities 14 in the tower 11. Each lock 22 is cantilevered forward from a rear end that is connected with the inner wall of the cavity 14, and is resiliently deformable up and down in a direction intersecting an insertion direction of the terminal fittings into the cavities 14. A locking projection 23 is formed near the free front end of the lock 22 and projects towards the cavity 14. Mold removal spaces 24 are left in the front wall of the tower 11 as the locks 22 are formed, and front-stop walls 25 for the terminal fittings are formed for the respective cavities 14 adjacent to the mold removal spaces 24. Upper parts of the terminal fittings contact the rear surfaces of the front-stop walls 25. Each front-stop wall 25 has a tab insertion opening 26, and a slanted surface 27 is formed at the front surface of the opening edge for guiding the male tab.

The outer peripheral surface of the tower 11 is recessed slightly to form a facing surface to be covered by the surrounding wall 32 of the front holder 13, and a seal (not shown) made of resilient material (such as rubber or gelatinous material) is mounted to a rear part of the facing surface. The seal is sandwiched in forward and backward directions FBD between the rear end of the front holder 13 and a step formed in the tower 11. The seal 15 closely contacts the inner peripheral surface of the receptacle 61 and the outer peripheral surface of the tower 11 when the housings 10, 60 are connected to provide fluid- or watertight sealing between the housings 10, 60.

Figure 4:
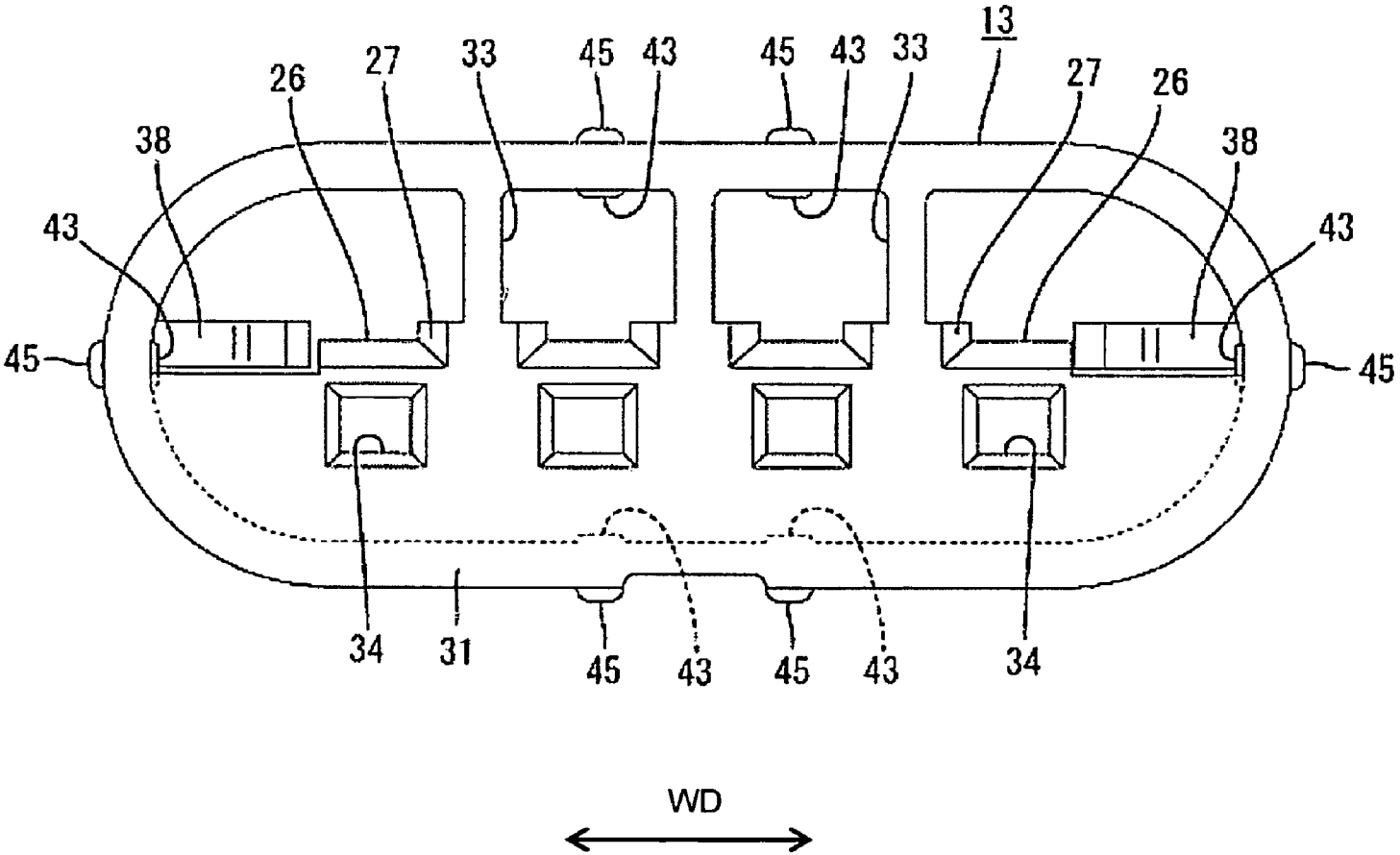
FIG. 4 is a front view of the front holder.
Figure 5:
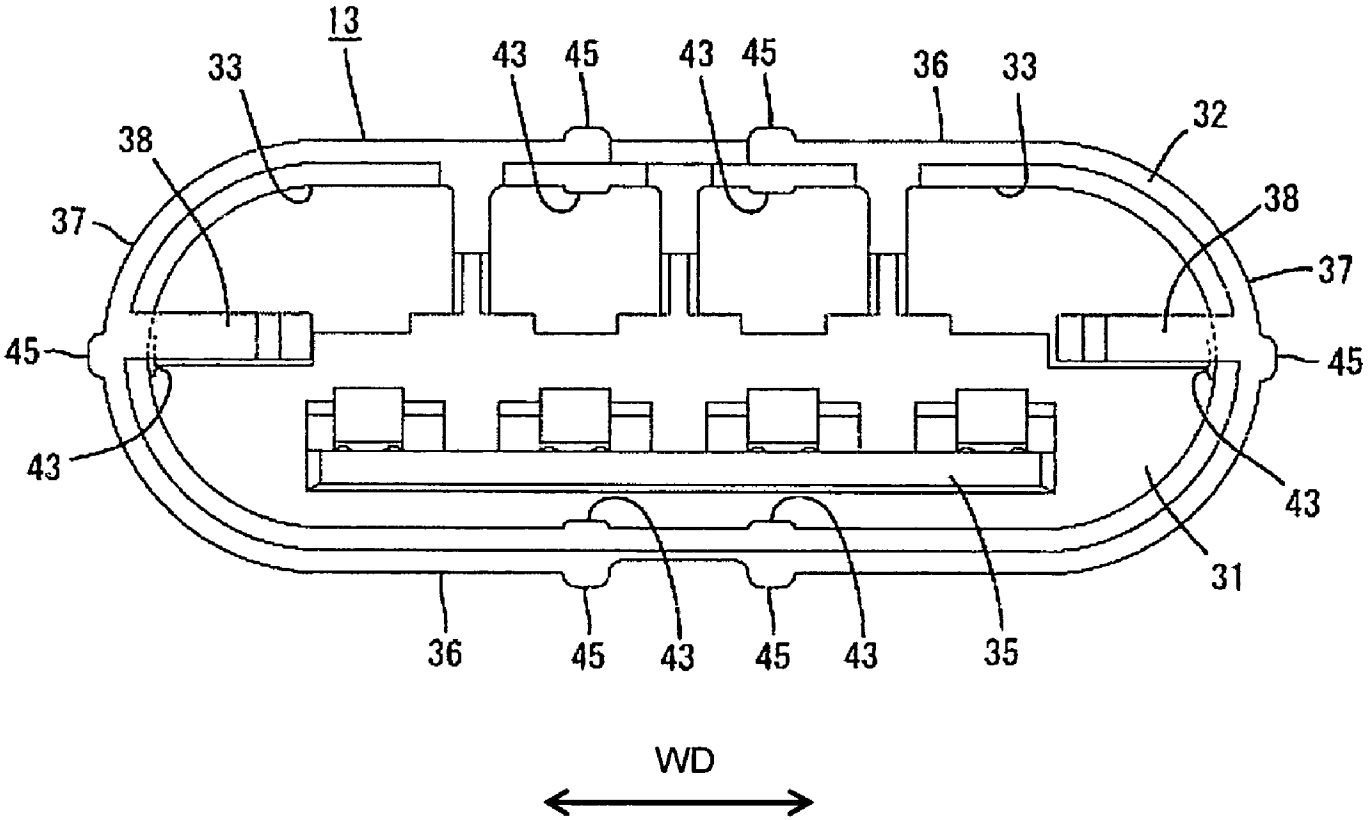
FIG. 5 is a rear view of the front holder.
Figure 6:
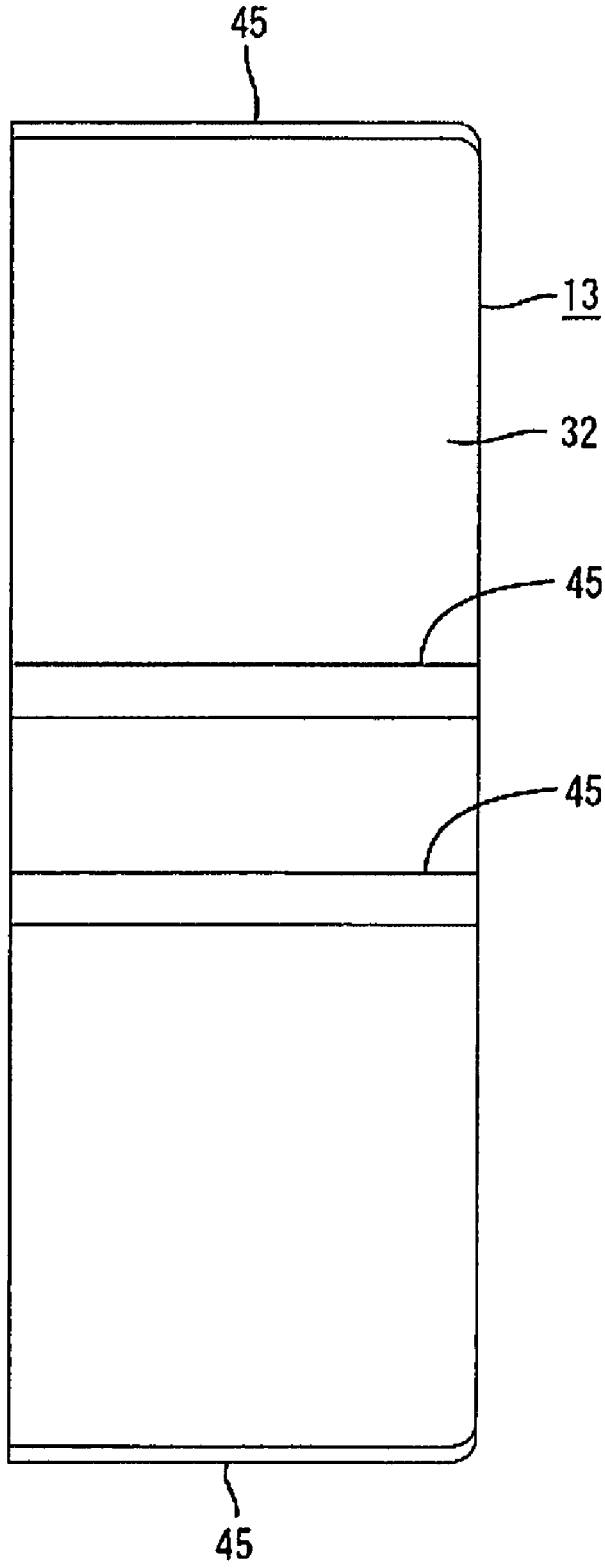
FIG. 6 is a plan view of the front holder.
Figure 7:
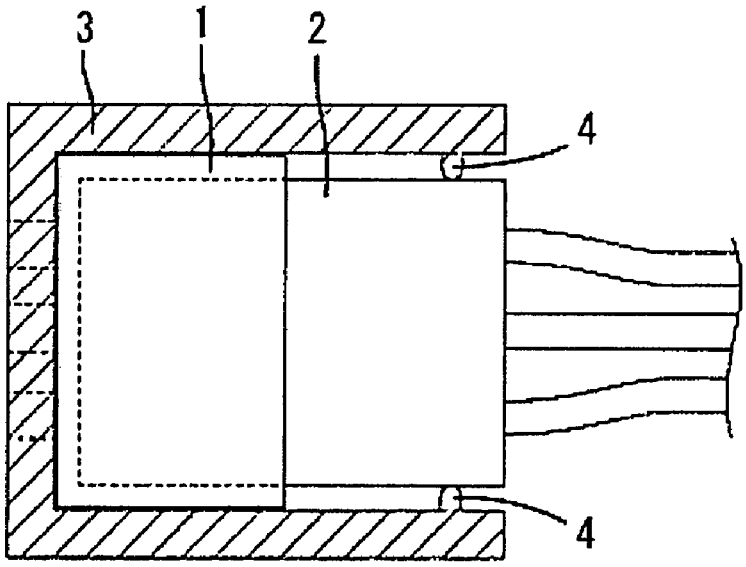
FIG. 7 PRIOR ART
FIG. 7 is a section schematically showing a prior art.

The front holder 13 is made e.g. of a synthetic resin and has a front wall 31 for covering the front of the tower 11 to form at least part of front ends of the cavities 14. The surrounding wall 32 projects back from the peripheral edge of the front wall 31 and covers the outer peripheral surface of the tower 11, as shown in FIGS. 4 to 6. The front wall 31 has a wide rounded shape in front view, and windows 33 are arranged transversely in the upper part of the front wall 31 in conformity with the cavities 14. The windows 33 receive the respective front-stop walls 25 of the tower 11. Edges of the windows 33 in the front wall 31 are cut to form the lower parts of the tab insertion openings 26, and slanted surfaces 27 are formed at the front surfaces of the opening edges for guiding the male tabs.

The tab insertion openings 26 of the front holder 13 and of the front-stop walls 25 become substantially continuous in the circumferential direction, as shown in FIG. 2, when the front holder 13 is mounted properly on the tower 11, and the slanted surfaces 27 extend continuously around the tab insertion openings 26. Jig insertion openings 34 are formed in the front wall 31 of the front holder 13 adjacent the respective windows 33 and can receive a jig for canceling the locked state by the lock 22. The mold removal spaces 24 of the tower 11 are at least partly inside the jig insertion openings 34, and the leading ends of the locks 22 can be seen through the jig insertion openings 34. The jig can be inserted into the jig insertion opening 34 from the front so that the leading end of the jig is brought into hooking engagement with the leading end of the lock 22. The jig then is levered forcibly to deform the lock 22 in an unlocking direction and to cancel the locked state of the lock 22.

A deformation preventing portion 35 projects back from the rear surface of the front wall 31 of the front holder 13 at a position below the respective window holes 33 and extends substantially in a width direction WD. The deformation preventing portion 35 projects at least partly into the mold removal spaces 24 of the tower 11 and enters deformation spaces for the locks 22 to hinder deformation of the locks 22 when the front holder 13 is mounted properly. Accordingly, the properly inserted terminal fittings are locked primarily in the cavities 14 by the locks 22 and are locked secondarily by the deformation preventing portion 35 to achieve double locking.

The surrounding wall 32 of the front holder 13 has two opposed wide planar panels 36 and two opposed arcuate panels 37 that extend between opposite sides of the planar panels 36. The planar panels 36 have a thickness substantially equal to the height of the step of the tower 11 and extend straight in the width direction WD. Two locking arms 38 project in at intermediate height positions of the arcuate panels 37. The locking arms 38 are resiliently deformable in and out, and hold the front holder 13 at a partial locking position and a full locking position on the tower portion 11 by engaging locking areas of the tower 11. The front wall 31 is spaced forward from the front surface of the tower 11 when the front holder 13 is at the partial locking position and the deformation preventing portion 35 is retracted from the deformation spaces for the locks 22. Thus, the locks 22 can deform and the terminal fittings can be inserted into the cavities 14. On the other hand, the front wall 31 contacts the front surface of the tower 11 and the deformation preventing portion 35 enters the deformation spaces for the locks 22 from the front when the front holder 13 is pushed from the partial locking position to the full locking position. Thus, the locks 22 cannot deform and the terminal fittings are locked doubly. In other words, the front holder 13 also functions as a retainer.

Inner projections 43 project in from spaced apart positions on the inner peripheral surface of the surrounding wall 32 of the front holder 13. Outer projections 45 project out from spaced apart positions on the outer peripheral surface of the surrounding wall 32 of the front holder 13. The inner and outer projections 43, 45 are substantially flat trapezoidal ribs that extend in forward and backward directions FBD over substantially the entire length of the surrounding wall 32, as shown in FIG. 6. The inner and outer projections 43, 45 have small projecting distances, and the projecting distance of the outer projections 45 is smaller than that of the inner projections 43.

Two upper inner projections 43 and two lower inner projections 43 are arranged substantially symmetrically on the planar panels 36 of the surrounding wall 32 at opposite sides of the widthwise centers, and left and right inner projections 43 are arranged substantially in the centers of the arcuate panels 37 of the surrounding wall 32 in height direction. The outer projections 45 are arranged similar to the inner projections 43 and have a substantially back-to-back relationship with the inner projections 43 with the surrounding wall 32 therebetween. The inner and outer projections 43, 45 provided on the wide planar panels 36 are arranged at substantially the same positions as the widthwise centers of the inner two cavities 14 with respect to the width direction WD when the front holder 13 is in its mounted state. Thus, the inner projections 43 on the wide planar panels 36 can be seen through the windows 33 from the front.

The terminal fittings are inserted into the cavities 14 of the tower 11 from behind with the front holder 13 held at the partial locking position. As a result, the locks 22 engage and hold the terminal fittings that have been inserted properly. The front holder 13 then is pushed to the full locking position. As a result, the deformation preventing portion 35 of the front holder 13 prevents deformation of the locks 22 to lock the terminal fittings redundantly. The leading end surfaces of the inner projections 43 of the surrounding wall 32 contact the outer peripheral surface of the tower 11 (contact state is shown in FIG. 2) when the front holder 13 reaches the full locking position.

The tower 11 having the front holder 13 mounted thereon can be fit into the mating receptacle 61 to a proper depth. As a result, the male tabs in the receptacle 61 enter the cavities 14 through the tab insertion openings 26 and connect electrically with the terminal fittings in the cavities 14. At this time, the terminal fittings and the mating male tabs have their contact positions substantially in the widthwise centers of the respective cavities 14, and these widthwise centers of the cavities 14 are at substantially the same positions as the widthwise centers of the locks 22 with respect to the width direction WD. The leading end surfaces of the outer projections 45 of the surrounding wall 32 contact the inner peripheral surface of the receptacle 61 (contact state is shown in FIG. 2) when the two housings 10, 60 are connected properly.

The terminal fittings and the male tabs could slide against each other and displace their connection positions within the range of a clearance between the receptacle 61 and the tower 11, if the entire connector is vibrated while the housings 10, 60 are connected. This sliding movement could result in an unreliable connection between the terminal fittings and male tabs. However, the front holder 13 is interposed between the receptacle 61 and the tower 11, and clearances to the outer peripheral surface of the tower 11 are filled by the inner projections 43 on the inner peripheral surface of the surrounding wall 32 of the front holder 13. Similarly, clearances to the inner peripheral surface of the receptacle 61 are filled by the outer projections 45 on the outer peripheral surface of the surrounding wall 32 of the front holder 13. Thus, loose movements of the front holder 13 and the tower 11 in the receptacle 61 are prevented, and relative positions of the receptacle 61 and the tower 11 are kept constant to avoid sliding movements of the terminal fittings.

The inner and outer projections 43 and 45 on the front holder 13 prevent the front holder 13 and the tower 11 from shaking in the receptacle 61. More particularly, the front holder 13 is interposed between the receptacle 61 and the tower 11 and the clearances between the receptacle 61 and the tower 11 are filled substantially by the inner and outer projections 43 and 45 projecting from the inner and outer peripheral surfaces of the front holder 13. Thus, as compared to the case where shake preventing projections project from only one of the receptacle 61 and the tower 11 toward the other, the projecting distances of the inner and outer projections 43 and 45 are reduced remarkably. As a result, the inner and outer projections 43 and 45 are stronger and surface sinks or the like during the molding can be prevented.

The inner and outer projections 43 and 45 are arranged to have a substantially back-to-back relationship (e.g. radial alignment) with the surrounding wall 32 therebetween. Thus, rigidity is improved in these parts of the surrounding wall 32, and the surrounding wall 32 is less likely to deform plastically upon the exertion of an external force.

The inner and outer projections 43, 45 on the wide planar panels 36 of the surrounding wall 32 of the front holder 13 are arranged at substantially the same positions as the widthwise centers of the cavities 14 with respect to the width direction WD and substantially at the contact positions of the terminal fittings. Thus, loose movements of the tower 11 in the receptacle 16 can be suppressed at positions close to the contact positions of the both terminal fittings to maintain the connection reliability of the both terminal fittings.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The front holder has the deformation preventing portion in the foregoing embodiment and functions as a retainer. However, the front holder may only function to form part of the front surface portions of the cavities without including the deformation preventing portion.

The inner and outer projections are ribs that extend substantially over the length of the surrounding wall of the front holder in the foregoing embodiment. However, the inner and outer projection may have short lengths in forward and backward directions FBD according to the invention.

The inner and outer projections are in back-to-back relationship in the foregoing embodiment. However, they may be displaced in the width direction WD with the surrounding wall therebetween.

Inner and outer projections are arranged substantially at the contact positions of the terminal fittings with respect to the width direction WD in the foregoing embodiment. However, only the inner or the outer projections may be arranged at the contact positions of the both terminal fittings with respect to the width direction according to the invention.

What is claimed is:

1. A connector, comprising:

a first housing including a tower formed with at least one cavity for accommodating at least one terminal fitting;

a front holder mountable on the tower and having a front wall for covering at least part of a front surface of the tower and a surrounding wall (32) projecting from the front wall for covering an outer peripheral surface of the tower;

a second housing having a receptacle for receiving the tower of the first housing with the front holder mounted thereon;

inner projections on an inner peripheral surface of the surrounding wall of the front holder and projecting towards the outer peripheral surface of the tower; and outer projections on an outer peripheral surface of the surrounding wall of the front holder and projecting towards the inner peripheral surface of the receptacle, whereby the inner and outer projections substantially prevent shaking between the first and second housings, the outer projections and the inner projections being at positions aligned respectively with one another with the surrounding wall being therebetween and projecting distances of the inner and outer projections being selected to achieve contact of the inner and outer projections with tower and the receptacle respectively.

2. The connector of claim 1, wherein the surrounding wall projects from a peripheral edge of the front wall.

3. The connector of claim 1, wherein at least one of the outer and inner projections align substantially with a contact position of the terminal fitting and a mating terminal fitting.

4. The connector of claim 1, wherein projecting distances of the inner projections exceed projecting distances of the outer projections.

5. The connector of claim 1, wherein at least one front-stop wall for the terminal fitting is formed for the cavity.

6. The connector of claim 5, wherein an opening edge of a part of a tab insertion opening is formed in the front-stop wall, and wherein a slanted surface for guiding the male tab is formed on a front surface of the opening edge.

7. The connector of claim 1, wherein the inner and outer projections are formed to be unitary with the front holder.

8. A connector, comprising:

a first housing including a tower formed with at least one cavity for accommodating at least one terminal fitting;

a front holder mountable on the tower and having a front wall for covering at least part of a front surface of the tower and a surrounding wall projecting from the front wall for covering an outer peripheral surface of the tower, inner projections projecting unitarily from an inner peripheral surface of the surrounding wall of the front holder and substantially contacting the outer peripheral surface of the tower, outer projections projecting unitarily from an outer peripheral surface of the surrounding wall of the front holder, the outer projections and the inner projections being at positions aligned respectively with one another with the surrounding walls being therebetween; and a second housing having a receptacle mounted over the front holder, the receptacle being dimensioned so that the outer projections of the front holder substantially contact an inner peripheral surface of the receptacle, whereby the inner and outer projections substantially prevent shaking between the first and second housings.

9. The connector of claim 8, wherein at least one of the outer and inner projections align substantially with a contact position of the terminal fitting and a mating terminal fitting.

10. The connector of claim 8, wherein projecting distances of the inner projections exceed projecting distances of the outer projections.

11. The connector of claim 8, wherein the front holder has opposite front and rear ends, the inner and outer projections extending substantially from the front end of the front holder to the rear end of the front holder.

12. The connector of claim 8, wherein each of the inner and outer projections is an elongate rib extending substantially from a front end of the front holder to a rear end thereof and defining a substantially flat trapezoidal cross sectional shape with substantially planar surfaces extending substantially parallel to surface areas of the surrounding wall adjacent the respective projection.

* * * * *